US008215002B2

(12) United States Patent
Tucker et al.

(10) Patent No.: US 8,215,002 B2
(45) Date of Patent: Jul. 10, 2012

(54) METHOD OF MAKING A LAMP COIL

(75) Inventors: Michael D. Tucker, Henniker, NH (US); Charles M. Coushaine, Rindge, NH (US); Daniel D. Devir, South Sutton, NE (US); Paul Okerholm, West Gardner, ME (US); Douglas Bottom, Keene, NH (US); Stuart K. Denham, Waldoboro, ME (US)

(73) Assignee: OSRAM SYLVANIA Inc., Danvers, MA (US)

( * ) Notice: Subject to any disclaimer, the term of this patent is extended or adjusted under 35 U.S.C. 154(b) by 1057 days.

(21) Appl. No.: 11/904,815

(22) Filed: Sep. 29, 2007

(65) Prior Publication Data

US 2009/0085456 A1 Apr. 2, 2009

(51) Int. Cl.
*H01F 7/06* (2006.01)

(52) U.S. Cl. ..... 29/605; 29/602.1; 29/606; 242/437.3; 242/437.4; 242/443; 242/445.1; 313/274; 336/212; 336/234

(58) Field of Classification Search ..... 29/602.1, 29/605, 606; 242/437.3, 437.4, 443, 445.1; 336/212, 234; 313/274
See application file for complete search history.

(56) References Cited

U.S. PATENT DOCUMENTS

| | | | | |
|---|---|---|---|---|
| 3,029,360 | A | 4/1962 | Etter | |
| 3,134,691 | A | 5/1964 | Kopecky | |
| 3,665,240 | A * | 5/1972 | Archer | 313/344 |
| 3,778,664 | A * | 12/1973 | Petro et al. | 313/344 |
| 4,661,739 | A | 4/1987 | Dvorak et al. | |
| 4,918,356 | A | 4/1990 | Enyedy et al. | |
| 4,939,411 | A | 7/1990 | Kern | |
| 5,019,743 | A * | 5/1991 | Olwert et al. | 313/25 |
| 5,168,193 | A | 12/1992 | Hoegler | |
| 5,250,873 | A | 10/1993 | McHugh | |
| 5,404,069 | A | 4/1995 | Olwert et al. | |
| 5,550,423 | A | 8/1996 | Oughton | |
| 5,705,882 | A | 1/1998 | Oughton | |
| 2007/0182326 | A1 * | 8/2007 | Versluijs | 313/578 |

* cited by examiner

*Primary Examiner* — Paul D Kim
(74) *Attorney, Agent, or Firm* — Edward S. Podszus

(57) ABSTRACT

Traditional methods of making headlamp coils have left a portion of the coils with slightly irregular forms. These irregularities can result in defects in the ultimate beam pattern. Accommodating these defects in robust lamp and headlamp optical systems can reduce the performance that might otherwise be available. The preferred coil is therefore continuously coiled as a straight body, and carefully cut into segments. Subsequently, legs are welded to the coil segment ends. The coil is then left substantially undistorted by the manufacturing process that would otherwise normally leave a portion of the coils distorted. The method particularly enables a functional center leg coil.

12 Claims, 7 Drawing Sheets

METHOD OF MAKING A LAMP COIL

1. TECHNICAL FIELD

The invention relates to lamps and particularly to electric lamps. More particularly the invention is concerned with filaments for electric lamps.

2. BACKGROUND ART

Automotive headlamps are commonly made with tungsten filaments. In one construction the coil ends are trapped between the folded ends of lead wires. A lead wire is a typically a nickel iron or molybdenum rod with a substantially greater diameter. The fold on the lead end is pressed closed to trap an end of the coil. If the fold presses directly on the coil, the turns of the coil are variably flexed, twisted, or turned, as they are crush in the press. This distorts the remaining portions of the coil.

Alternatively, a coil may be formed with a leg portion comprising a straight section of the coil wire that extends away from the coil body. The leg is then trapped in the lead. Generally this results in less coil distortion, but not completely so. The legs themselves may be bent, twisted or turned in being held by the lead. Since the coil wire is substantially thinner than the lead wire, the lead has to be distorted a great deal to accommodate the smaller coil leg wire. The leads are then pre-formed, flattened or similarly prepared for the final capture between the coil leg and the lead wire. Nonetheless variations in the lead preliminary or final formation, act to variably squirm the coil leg and therefore the coil itself.

An alternative to the direct coil leg to lead coupling is to provide an interface between the two wires. The lead then does not have to be bent so much during final deformation to capture the coil leg. Less distortion has then been achieved. The interface is typically a small sleeve that is slipped over an end of the coil leg and clamped in place. The sleeve provides a thicker leg for the coil, which is then easier to grasp by the lead. Attaching the sleeve has its own set of complications, costs and difficulties. In the end, it is still subject to transmitting the coupling distortions into the coil body.

Another difficulty with the coil and leg constructions is the leg itself is formed as part of the coil, which can leave an initial distortion in the coil.

Automotive filament coils are commonly made individually with the end sections formed as legs bent after winding the helix. Due to variations in wire weight, composition, winding temperature, and other factors the same number of mechanical turns in coil winding can bend the wire more (over wind) or less (under wind). The coils then have larger or smaller diameters and the legs are angularly more or less offset. Bringing the legs in to proper alignment by turning them as little as 25 degrees tensions to coil enough to "squirm" it. Bending the legs for subsequent attachment can also distort the coil. The coil has to be held while the bend is made. This tends to distort the coil with unpredictable results. The local crystal structure of the coil varies along its length, so the distortion may be relieved at any random point. The resulting coils are then bowed unpredictably. This is acceptable for Edison bulbs, but it is bad for fine optical applications such as headlamps.

DISCLOSURE OF THE INVENTION

The preferred method is to make the coil continuously without legs. The helix is laser cut at the right lengths. Legs are then laser welded onto the final turns after cutting. The heating, annealing of the welding process does not distort the coil, and does not induce irregular bends in the coil ends. The legs may have any desired form, or size and may be external or internal to the helix core. The coil can be made with varying pitches. In essence the idea is a method of making.

BEST MODE FOR CARRYING OUT THE INVENTION

Figure 1:
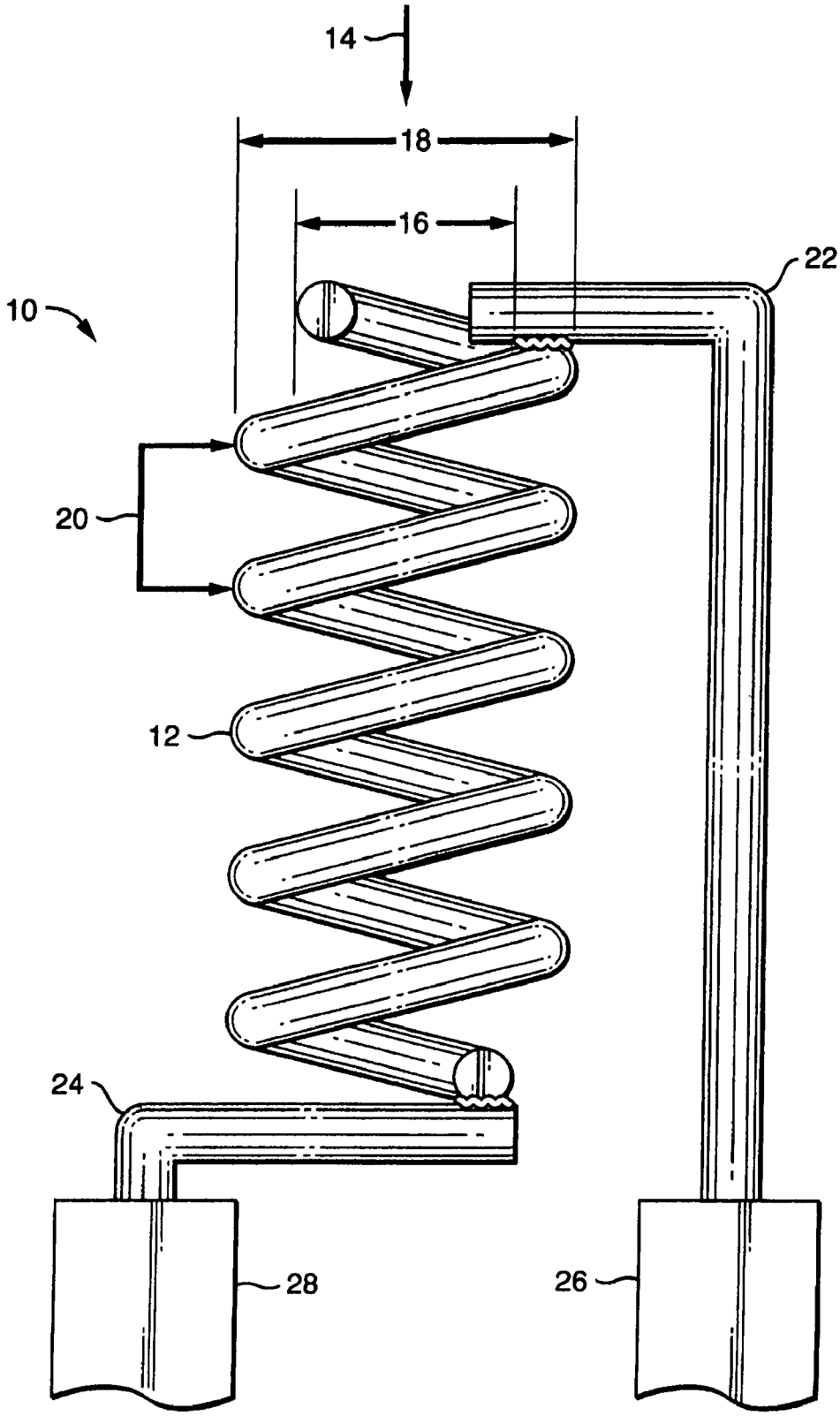
FIG. 1 shows a schematic view of a preferred embodiment of a coil and leg assembly.

FIG. 1 shows a preferred embodiment of a coil and leg assembly 10. The preferred coil 12 is formed with tungsten wire, which is meant to include tungsten alloys. The more consistent the wire is in composition, and diameter the better. The preferred wire has a nearly fixed round diameter. During the wire draw, it is common for the wire diameter to vary slightly, and this is most easily detected as a variation in the wire weight per unit length (per coil). The preferred wire has a wire weight variation of plus or minus one half of one percent. The nearly constant weight wire is formed into a continuous tungsten coil 12 having a generally helical form with an open axial passage 14 with an internal diameter 16, an external diameter 18 and a pitch 20. Welded to the coil ends are legs 22, 24 that may include sleeves 26, 28. The first step is to provide a continuous supply of true filament coil (nearly constant weight per length, inside and outside diameters, and pitch).

Figure 2:
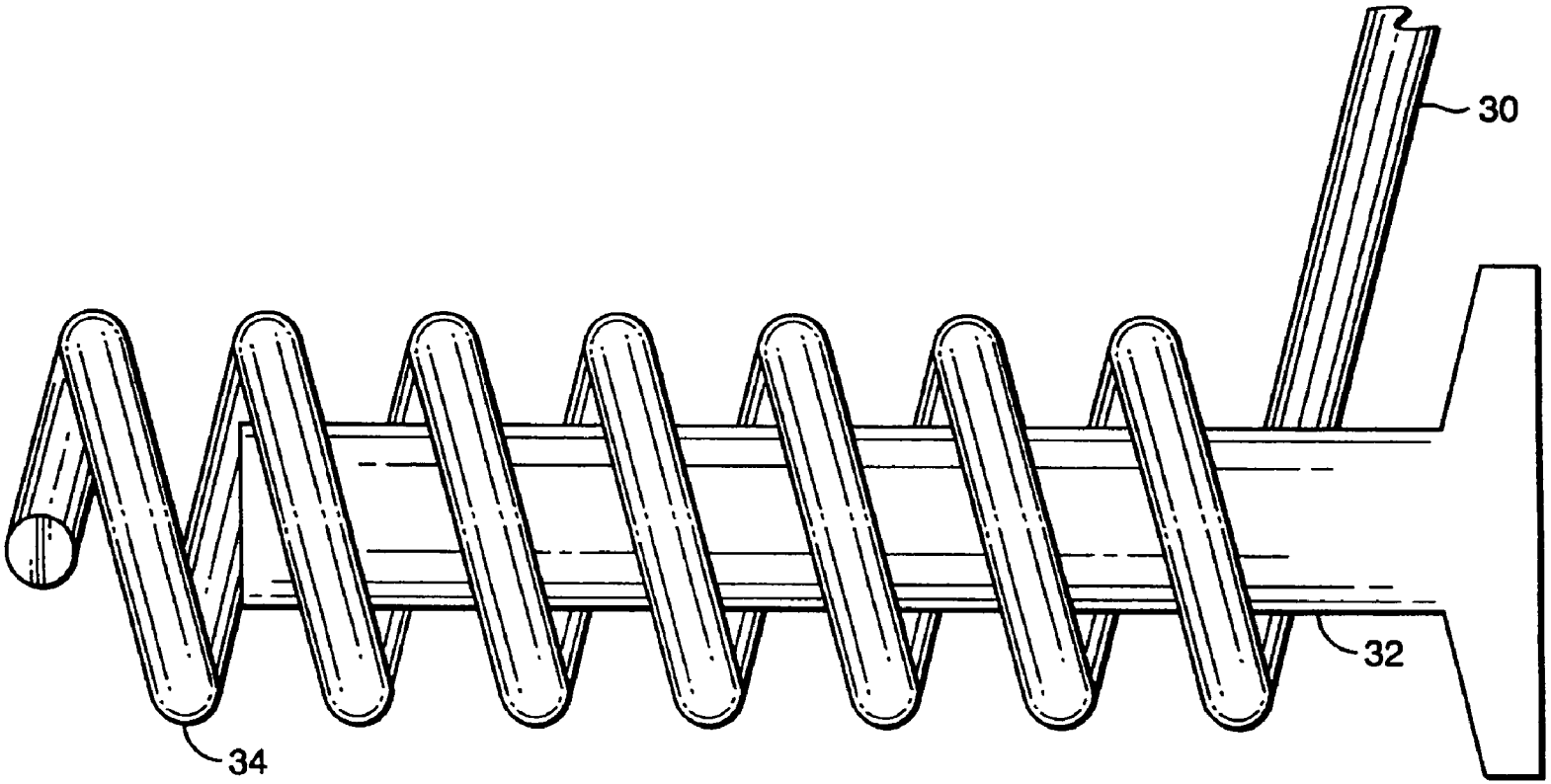
FIG. 2 shows a schematic view of a wire wound on an arbor to form a continuous coil.

FIG. 2 schematically shows a wire 30 wound on an arbor 32 to form a continuous coil 34. The constant weight wire is continuously wound on an arbor 32 at a constant temperature to issue a continuous coil 34 (broken away). It is understood that variable pitch filaments may be made, and such filaments are generally intended to be included in the scope of this description. The continuously wound coil 34 is then cut into segments. It is preferred that the coil 34 not be distorted during cutting. The preferred cutting occurs without mechanically flexing the coil, as would occur for example with a blade or similar shearing device. Mechanical flexing can distort the coil. The preferred cutter is a non-mechanical cutter, such as a laser or similar device that supplies sufficient energy to a spot along the coil where the cut is to be made so as to melt, vaporize, or similarly segment the coil wire without extending mechanical stresses into the coil so as to bend or distort the length of the coil wire. The coil may also be cut with little mechanical distortion by heating the cut point with a laser forming a hot spot that is then struck with a shear. The goal is to cut the continuous coil without distorting the coil segment, and any method that substantially achieves that result is acceptable. The cut coil should remain axially straight and should retain the desired pitch, inside diameter, and outside diameter after cutting as before cutting. The cut coil then forms a straight coil segment 36 having a first end 38 and a second end 40.

Figure 3:
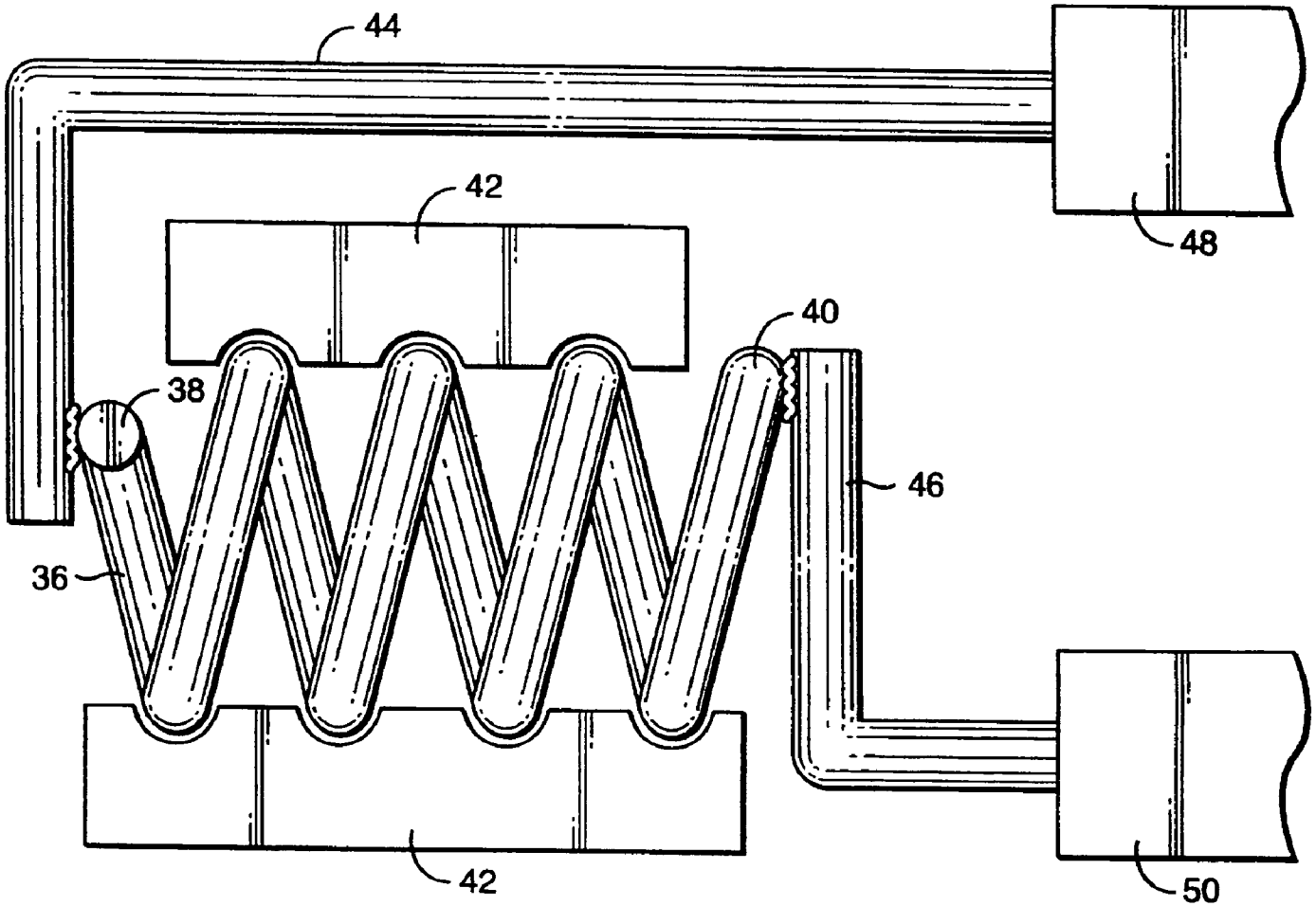
FIG. 3 shows a schematic view of a coil held in a coil nest for welding.

FIG. 3 schematically shows a coil 36 held in a coil nest 42 for welding. The coil 36 is held in a coil nest 42 without twisting or otherwise distorting the coil 36. A preferred coil nest 42 is a snuggly fitting frame that molds closely to the exterior outlines of the coil segment 36 leaving at least one end 38 exposed for coupling.

The preferred legs 44, 46 are made from molybdenum, but they could be made from tungsten. They are pre-cut and shaped and may include sleeves 48, 50. A first leg 44, previously formed, is extended to touch the first end 38 without distorting the coil 36 or the first leg 44. In the basic embodiment, the first leg 44 is extended as a J or L shaped body that just touches the correct point along the cut coil segment 36. The cut coil segment 36 or the first leg 44 may be formed to have lengths to overlap the two pieces (36, 44). This assures the pieces may be adjusted without distortion as they are brought together. The cut coil and the leg are then welded, for example by laser welding. A second leg 46 is similarly attached at the second end 40 of the cut coil. The legs 44, 46 (with or without intermediate sleeves 48, 50) then extend in the proper directions, from the proper places along the cut coil 36. The coil 36 and attached legs 44, 46 (48, 50) are then released from the coil nest 42, and attached to the support leads (conductive framework) as is known in the art of lamp making. Because the legs 44, 46 are consistently and accurately positioned, attachment to the support leads can be done with little or no adjustment distorting the coil (12, or 36). The result is a consistently and accurately placed undistorted coil (12, or 36).

Figure 4:
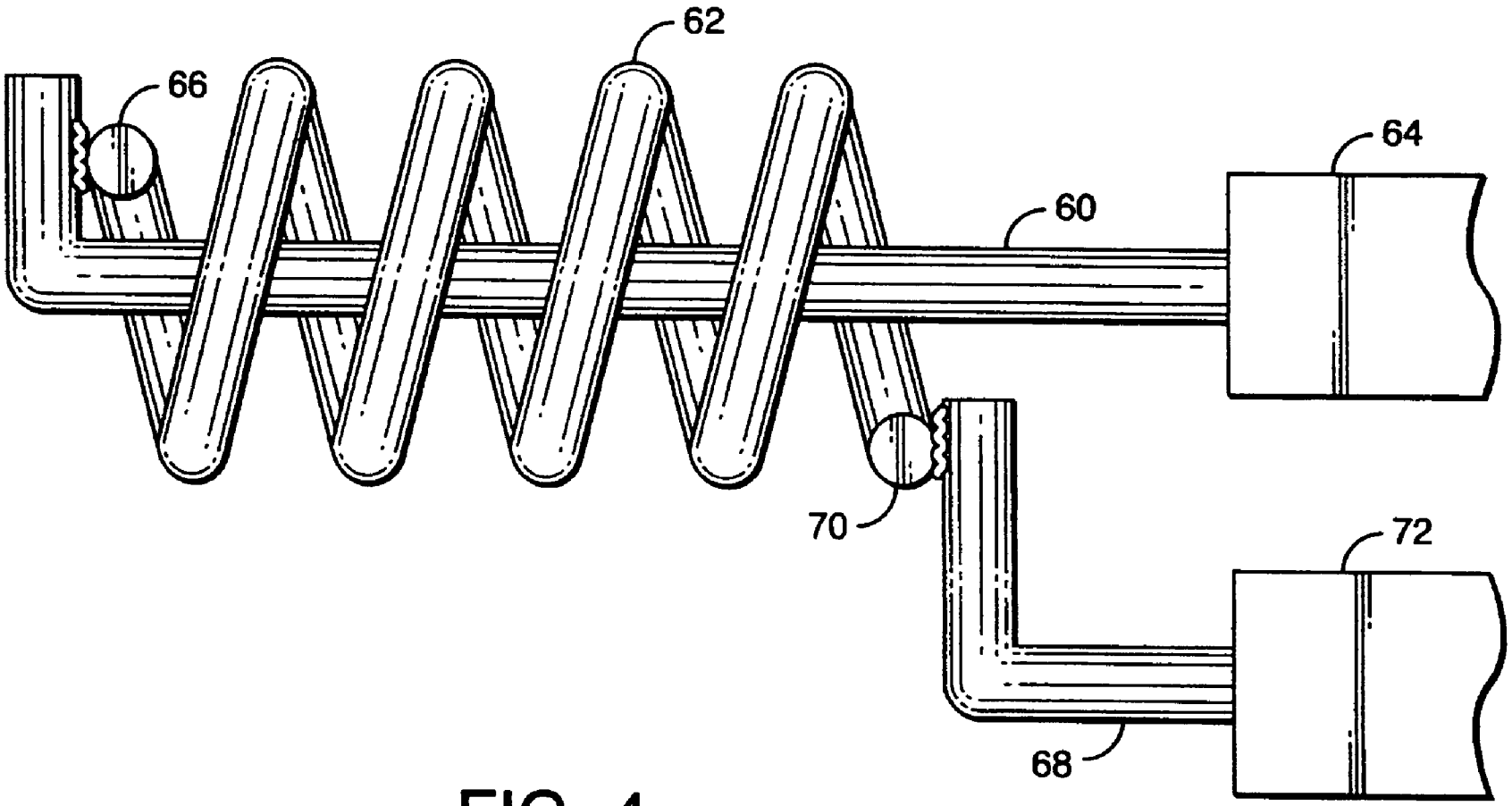
FIG. 4 shows a schematic view of an alternative embodiment of a coil and leg assembly.

FIG. 4 shows a preferred alternative embodiment of a coil and center leg assembly mounted to support leads. In this variation, the first leg 60 is extended axially through the center of the coil 62. The present method enables the center leg embodiment, without distorting the coil body. The center leg embodiment provides a number of optical advantages to headlamp and other lamp designers. In particular, the center leg 60 may be coupled to a lead 64 that is place below or away from the coil 62. There is then no center leg shadow and little or no support lead 64 shadow projected into the illuminated field. Equally, important there is no detrimental reflection from the center leg 60, and little or no reflection from the support lead 64 acting as secondary or so-called parasitic light sources. The light being projected is then not interfered with by the center leg 60, and very little by the attached lead 64 that would normally parallel the coil exterior. The center leg 60 in fact acts more as an ideal source, as reflections or shadows caused by it, are symmetrically distributed around the true filament axis.

The first end 66 is then electrically coupled to the first leg 60. In a similar fashion, a second leg 68 is aligned to extend away from the coil 62 and to touch the second end 70 without distorting the coil 62. The second end 70 is electrically coupled to a second leg 68, preferably again by laser welding without distorting the coil 62.

The first leg 60 and the second leg 68 are then aligned with and then attached respectively to a first lead 64 and a second lead 72 in an automotive lamp. Preferably the both the alignments and the attachments are made so as to not distort the coil 62. Since the coil structure has so far been constructed to nearly ideally locate the legs 60, 68 without distorting the coil 62, if the leads 64, 72 are in their respective correct positions, then the coil may be ideally positioned without distortion. In fact, the leads 64, 72 are generally well positioned, but not necessarily ideally. The lamp coil 62 is then subject to only the last distortion of not having the leads in proper position. This construction is then at least as good the old method, but frequently better in that errors in the coil structure have been substantially eliminated. Thereafter the lamp is completed as is normally done in the art of lamp making.

Figure 5:
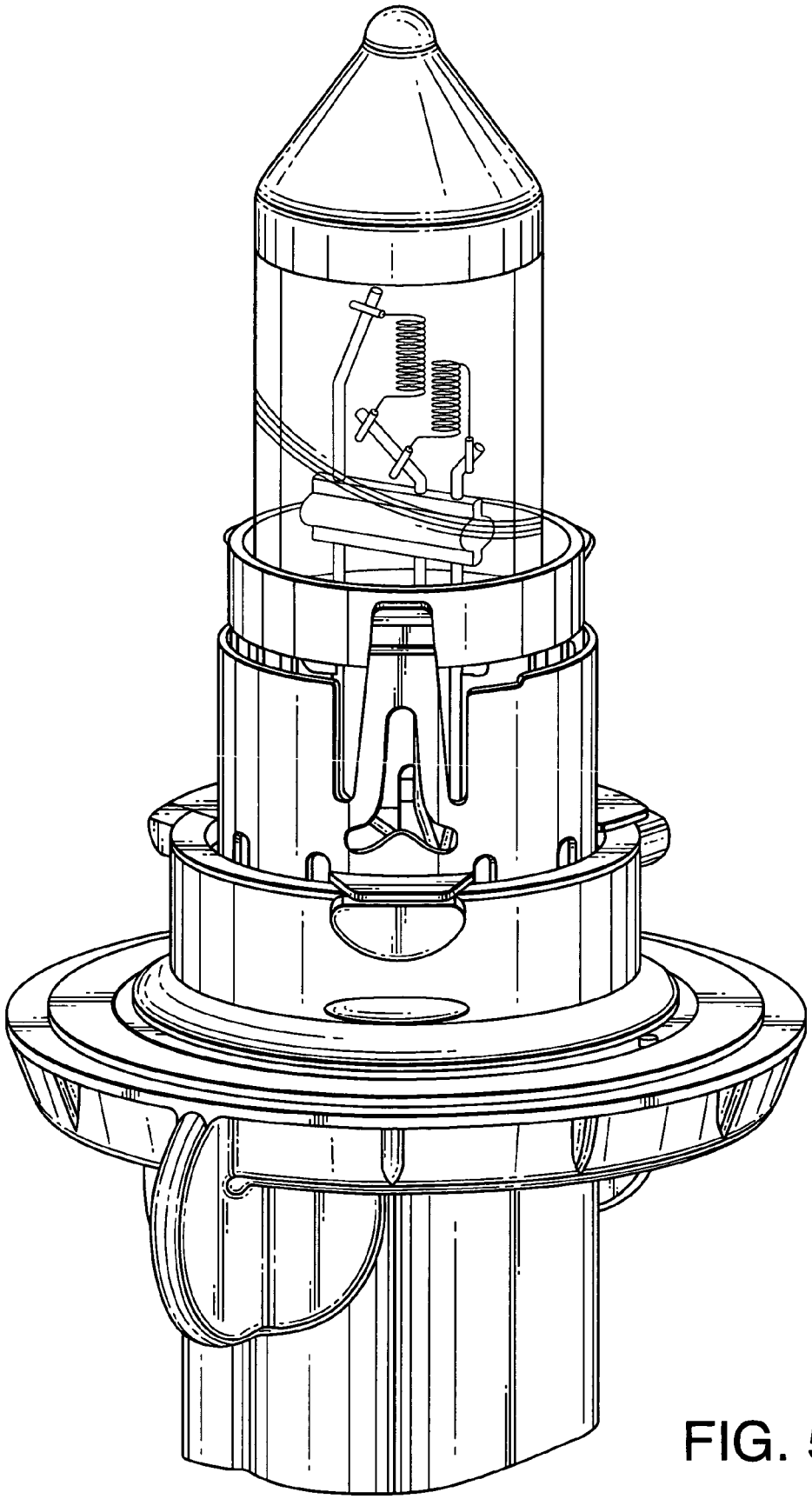
FIG. 5 shows a preferred embodiment of an assembled automotive lamp.
Figure 6:
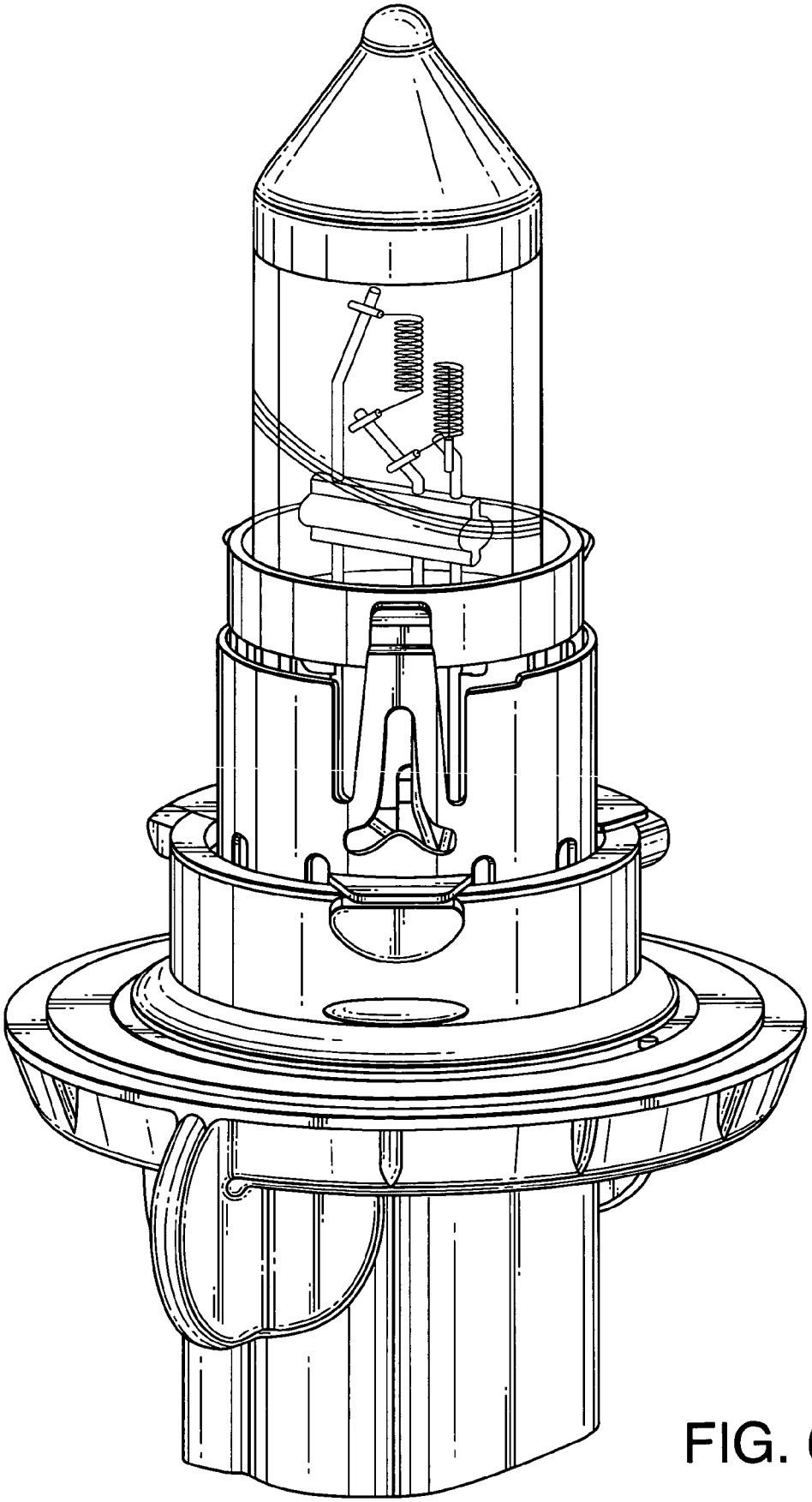
FIG. 6 shows a preferred center leg embodiment of an assembled automotive lamp.

The intended use for the coil assembly is in an automotive headlamp, where fine optical control is preferred for glare reduced head lighting. Such a lamp could include a coiled tungsten filament having an outer diameter less than 1.8 millimeters. The preferred internal diameter is 1.45 millimeters or less. The preferred external diameter is 1.8 millimeters or less. The preferred pitch is 175 to 185. It is possible to make a coil by forming a coil and bending only one end to form an outward extending leg. This single leg coil is then held in a relaxed state in a coil nest while a second leg is then attached in its true position to the second end (the end without the bent leg) by laser welding. This method is less preferred as bending the leg out can induce distortions, but it does provide some of the benefits described here. Again the preferred welded on leg is made of tungsten, and it is welded to a coil turn with a preferred orientation relative to the coil. A portion of the preferred first leg is enclosed in a first sleeve. A second leg made of molybdenum is similarly welded to the second end, and preferably a portion of the second leg is also enclosed in a sleeve. The second leg may be extended through the center of the helical coil from the first end to be welded to the second end. Center leg heaters and other filament structures have been used in the past, but in systems where the filament is sufficiently rigid, and sufficiently off set from the center leg so as to not cause a short circuit during vibration. In headlamps, the filament has to be as small as possible, so enlarging the internal diameter to accommodate a center leg was counter productive. This was particularly so, where the coil structure could not be reliably made straight or rigid. The attached leg method enables a consistently straight coil, so that a center leg filament system is now practical. The leg or first sleeve, as the case may be, is attached, for example by welding or crimping to a first input lead. The second leg or sleeve may be similarly attached to a second input lead. The filament held on the lead structures is then further enclosed by a light transmissive envelope, with the first lead and the second lead being sealed through the envelope for electrical connection on an exterior side of the envelope. The envelope may be held in a base that has electrical and mechanical connection features for convenient electrical connection in a lamp socket. In actual assembly the sequence of assembly may be varied for convenience, and in particular to accommodate accurate location or adjustment of the filament relative to the lamp surfaces used for mechanical seating, so that the filament finally resides in a preferred optical location, such as a focal point of a reflector the lamp is coupled to. FIG. 5 shows a preferred embodiment of an assembled automotive lamp. FIG. 6 shows a preferred center leg embodiment of an assembled automotive lamp.

FIG. 5 shows a preferred embodiment of an automotive lamp. Automotive filaments are manufactured to fit within specified exterior diameters that define the optical image that are used by reflector designers. Filaments that exceed these limits cause light to be projected in unexpected and usually undesirable ways. The current standard for the 9007 high beam radius is from 0.38 millimeters to 1.02 millimeters. The 9007 low beam radius is 0.38 millimeters. In comparison the welded leg filament can assure a straighter coil and therefore a narrower tolerance may be set. For what is call the NDF high beam filament the radius is from 0.23 millimeters to 0.33 millimeters. The 9007 low beam standard is 0.23 millimeters. This is a 40 percent reduction in filament image, greatly enabling a variety of improved reflectors and beam patterns. For example the beam accuracy may be improved (less reflector caused glare), or the reflector size may be reduced for the same accuracy.

Figure 7:
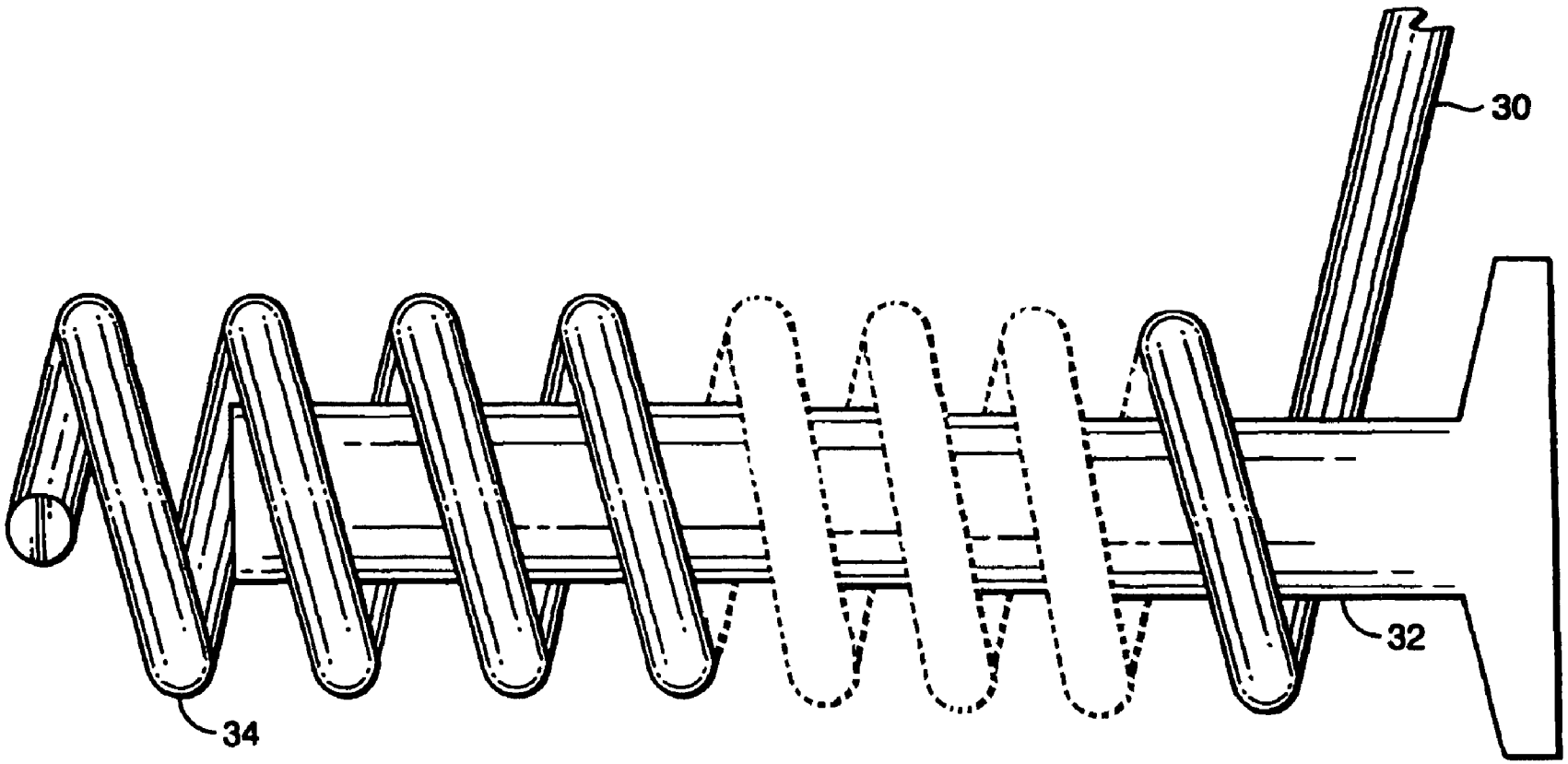
FIG. 7 shows a schematic view of a wire wound on an arbor to form a continuous coil with varying pitches. The broken lines showing of varying pitches are included for illustrative environmental purposes only.

FIG. 7 schematically shows a wire 30 wound on an arbor 32 to form a continuous coil 34 with varying pitches. The broken lines showing of varying pitches are included for illustrative environmental purposes only.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A method of making a lamp coil comprising the steps of:

a) forming a continuous coil having a generally helical form with an open axial passage;

b) cutting the continuous coil at desired lengths as coil segments each having a first end and a second end;

c) electrically coupling the first end to a first leg;

d) electrically coupling the second end to a second leg;

e) directly electrically coupling the first leg to a first lead; and f) directly electrically coupling the second leg to a second lead , and wherein the first leg is located to extend through the axial passage.

2. The method in claim 1, wherein the continuous coil is formed by:

a) providing a continuous supply of filament wire; and b) continuously winding the wire on an arbor to issue the continuous coil.

3. The method in claim 1, wherein the first end is laser welded to the first leg.

4. The method in claim 1, wherein the continuous coil has a first wire diameter, and the first leg and second leg have a second wire diameter greater than the first wire diameter.

5. A method of making a lamp coil comprising the steps of:

a) forming a continuous coil having a generally helical form with an open axial passage;

b) cutting the continuous coil at desired lengths as coil segments each having a first end and a second end;

c) electrically coupling the first end to a first leg;

d) electrically coupling the second end to a second leg;

e) directly electrically coupling the first leg to a first lead; and f) directly electrically coupling the second leg to a second lead, and wherein the continuous coil is cut by periodically flashing light on the continuous coil, the light having sufficient energy to separate a segment of the continuous coil.

6. A method of making a lamp coil comprising the steps of a) forming a continuous coil having a generally helical form with an open axial passage;

b) cutting the continuous coil at desired lengths as coil segments each having a first end and a second end;

c) electrically coupling the first end to a first leg;

d) electrically coupling the second end to a second leg;

e) directly electrically coupling the first leg to a first lead; and f) directly electrically coupling the second leg to a second lead, and wherein the continuous coil has a varying pitch.

7. A method of making a lamp coil comprising the steps of:

a) forming a continuous coil having a generally helical form with an open axial passage by providing a continuous supply of constant weight filament wire;

b) continuously winding the wire on an open ended arbor at a constant temperature to issue the continuous coil;

c) periodically cutting the continuous coil non-mechanically at desired points to form a straight coil segment having a first end and a second end;

d) holding the coil segment in a coil nest without twisting or otherwise distorting the coil segment;

e) aligning a first leg to touch the first end without distorting the coil segment or the first leg;

f) electrically coupling the first end to the first leg by laser welding; and g) aligning a second leg to touch the second end without distorting the coil segment;

h) electrically coupling the second end to the second leg by laser welding; and i) further directly electrically coupling respectively the first leg and the second leg to a first lead and a second lead in an automotive lamp.

8. The method in claim 7, wherein the first leg is laser welded to a lamp lead, and the second leg is laser welded to a second lead without distorting the coil segment.

9. The method in claim 7, wherein the continuous coil is formed from tungsten wire and the first leg and the second leg are formed from tungsten.

10. The method in claim 7, wherein the continuous coil is formed from tungsten wire and the first leg and the second leg are formed from molybdenum.

11. The method in claim 7, wherein at least one of the first leg and the second leg includes a sleeve portion.

12. A method of making an automotive lamp coil comprising the steps of a) forming a continuous tungsten coil having a generally helical form with an open axial passage by providing a continuous supply of constant weight filament wire;

b) continuously winding the wire on an arbor at a constant temperature to issue the continuous coil;

c) periodically cutting the continuous coil non-mechanically at desired points to form a straight coil segment having a first end and a second end;

d) holding the coil segment in a coil nest without twisting or otherwise distorting the coil segment;

e) aligning a first leg to extend axially through the center of the coil segment to touch the first end without distorting the coil segment or the first leg;

f) electrically coupling the first end to the first leg by laser welding without distorting the coil segment;

g) aligning a second leg extending away from the coil segment to touch the second end without distorting the coil segment;

h) electrically coupling the second end to the second leg by laser welding without distorting the coil segment;

i) aligning the coil segment and the first leg and the second leg adjacent a first lead and a second lead in an automotive lamp; and j) attaching respectively the first leg and the second leg to the first lead and the second lead, wherein the attaching is performed by laser welding without distorting the coil segment.

* * * * *